US009663316B2

(12) United States Patent
Hoffmann et al.

(10) Patent No.: US 9,663,316 B2
(45) Date of Patent: May 30, 2017

(54) WINDING DEVICE

(71) Applicant: Windmoeller & Hoelscher KG, Lengerich (DE)

(72) Inventors: Frank Hoffmann, Greven (DE); Oliver Koser, Lengerich (DE); Rolf Kammann, Westerkappeln (DE)

(73) Assignee: WINDMOELLER & HOELSCHER KG, Lengerich (DE)

( * ) Notice: Subject to any disclaimer, the term of this patent is extended or adjusted under 35 U.S.C. 154(b) by 132 days.

(21) Appl. No.: 14/442,806

(22) PCT Filed: Nov. 12, 2013

(86) PCT No.: PCT/EP2013/073634
§ 371 (c)(1),
(2) Date: May 14, 2015

(87) PCT Pub. No.: WO2014/076089
PCT Pub. Date: May 22, 2014

(65) Prior Publication Data

US 2015/0307304 A1 Oct. 29, 2015

(30) Foreign Application Priority Data

Nov. 14, 2012 (DE) ..... 10 2012 220 813

(51) Int. Cl.
*B65H 26/00* (2006.01)
*B65H 19/22* (2006.01)

(52) U.S. Cl.
CPC ..... *B65H 26/00* (2013.01); *B65H 19/2215* (2013.01); *B65H 19/2223* (2013.01); *B65H 2407/10* (2013.01)

(58) Field of Classification Search
CPC . B65H 26/00; B65H 19/2223; B65H 19/2215
See application file for complete search history.

(56) References Cited

U.S. PATENT DOCUMENTS

| | | | |
|---|---|---|---|
| 2,620,993 | A | 12/1952 | Jeffrey, Jr. |
| 3,185,402 | A | 5/1965 | Lenz et al. |
| 3,286,944 | A | 11/1966 | Kusel |
| 3,848,824 | A | 11/1974 | Van Schijndel |

(Continued)

FOREIGN PATENT DOCUMENTS

| | | |
|---|---|---|
| DE | 1965028 | 7/1967 |
| DE | 4104082 | 8/1992 |

(Continued)

*Primary Examiner* — Sang Kim
(74) *Attorney, Agent, or Firm* — Jacobson Holman, PLLC.

(57) ABSTRACT

A winding device for successively winding at least one material web, particularly a plastic film web, onto spools. The winding device includes a machine frame, at least one wheel which is mounted on the machine frame in a manner allowing rotation, at least two winding points for carrying the spools, which are mounted in the wheel in a manner allowing rotation, of which a first winding point is positionable in a winding position, and a second winding point is positionable in a loading and/or unloading position, with at least one guard element that is pivotably positionable in a region between the spools respectively associated with the first winding point and the second winding point.

6 Claims, 1 Drawing Sheet

(56) References Cited

U.S. PATENT DOCUMENTS

| | | | | | |
|---|---|---|---|---|---|
| 4,327,876 | A | * | 5/1982 | Kuhn | B65H 19/2223 242/527.4 |
| 4,575,019 | A | | 3/1986 | Hubbell | |
| 4,798,350 | A | | 1/1989 | Jorgensen et al. | |
| 5,012,985 | A | * | 5/1991 | Pepe | B65H 67/048 242/473.5 |
| 5,251,836 | A | | 10/1993 | Pack | |
| 6,273,356 | B1 | | 8/2001 | Burton | |

FOREIGN PATENT DOCUMENTS

| | | |
|---|---|---|
| EP | 1772407 | 4/2007 |
| EP | 2251290 | 11/2010 |

* cited by examiner

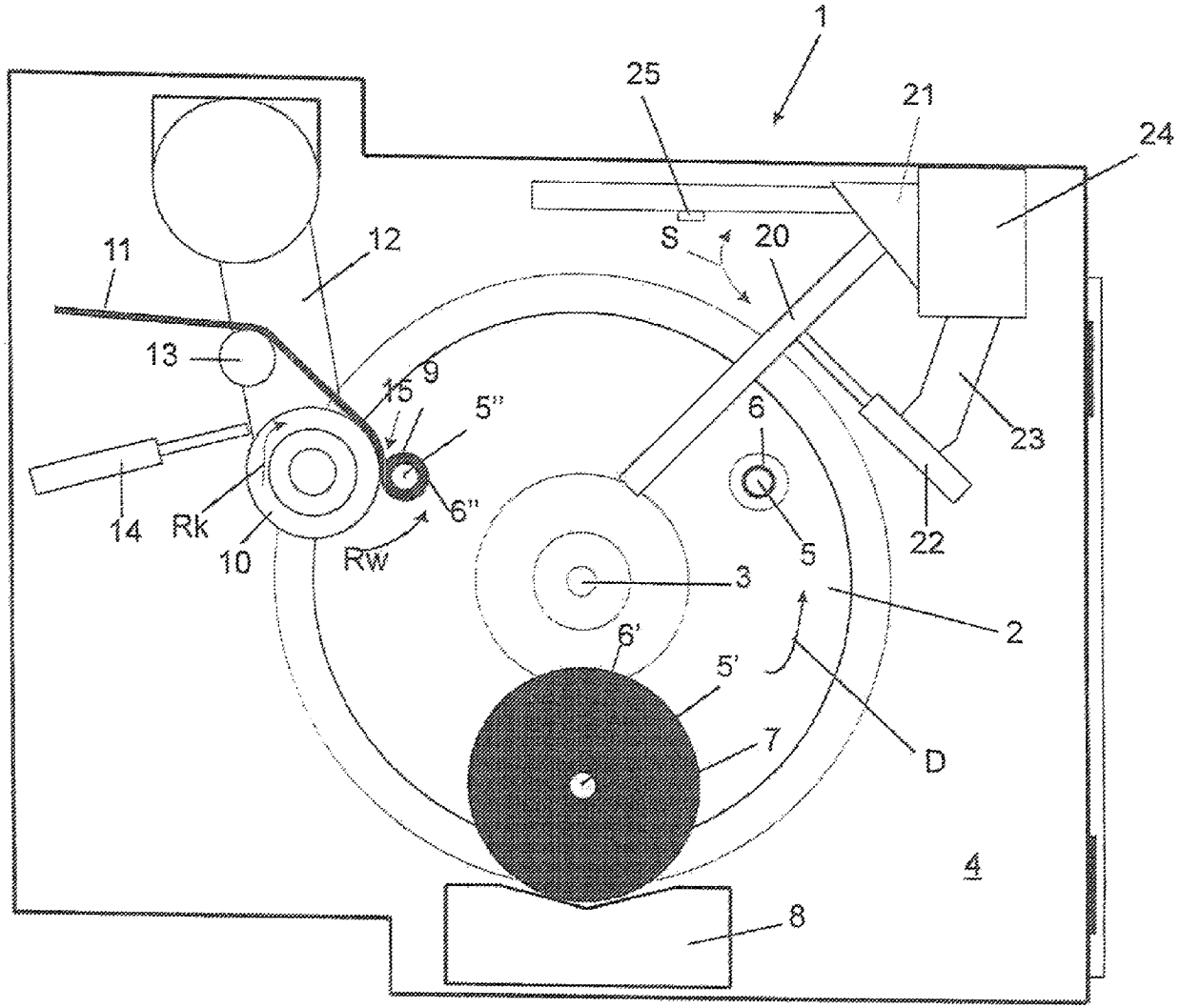
1
2
3
4
5
5'
5''
6
6'
6''
7
8
9
10
11
12
13
14
15
20
21
22
23
24
25
D
S
RW
Rk

WINDING DEVICE

CROSS-REFERENCE TO RELATED APPLICATIONS

This is a national stage of PCT/EP2013/73634, published in German.

BACKGROUND OF THE INVENTION

1. Field of Invention

The invention relates to a winding device according to the preamble of claim 1.

2. Description of the Prior Art

In such winding devices, a material web, which is produced continuously by a production machine, for example, is wound sequentially onto a spool in such a manner that rolls are created which are still manageable. The material web can optionally be divided by longitudinal cuts into different partial webs, wherein these partial webs can be wound in parallel.

There are various mechanical engineering and process design options in order to dispense with the need to halt the production of the material web for the changing of the winding roll and allow the spool to be changed while production continues.

As such, by way of example, so-called turret winders are known, wherein at least one wheel is mounted in a machine frame in a manner allowing rotation. The machine frame frequently comprises two perpendicular frame deflection points, wherein one such wheel is mounted in each of the same. At least two winding points are then mounted in a manner allowing rotation on this wheel. These winding points generally each comprise a winding axle which remains in the winding device during operation, and to which winding sleeves are applied, the material web being wound on the same.

In normal winding operation, one of these winding points is in the winding position in which the material web or webs is/are wound.

The at least one second winding point in this case is in a loading and/or unloading position. In this position, the wound winding sleeve—that is, the finished spool—is pushed out of the winding point, and new, empty winding sleeves are pushed into the winding point.

At this point, when the spool in the process of being wound reaches its intended size, the winding point configured with empty winding sleeves can be brought into the winding position by means of the at least one wheel.

Instead of one second winding point, multiple further winding points can be included, wherein in this case one of these winding points is generally in the unloading position, and a further of these winding points is in the loading position.

The operation of such winding devices has shown in practice that it is necessary to manually intervene in the loading and/or unloading processes from time to time. This is particularly the case when adhesive films are wound, because these films can adhere to machine components.

However, the high risk of accidents caused by the winding device continuing its operation is a disadvantage in this case.

SUMMARY OF THE INVENTION

The problem addressed by the present invention is therefore that of advancing a known winding device in such a manner that the risk of accident is reduced.

This problem is addressed according to the invention by the features described herein.

According to the claim, at least one guard element can be attached in the region between the two winding points.

With this measure, it is possible to shield the region in which the ongoing winding process takes place, in such a manner that an operator cannot access this region. In this way, the risk of accident is significantly reduced such that it is possible to intervene in the loading and/or unloading process without danger.

In one advantageous embodiment of the invention, the at least one guard element is mounted in the machine frame in a manner allowing pivoting. In this way, the guard element can be removed from this region of the wheel when the same is intended to be rotated at the spool change. A guard element which is arranged permanently on the wheel cannot be implemented because this would cause a disturbance during the change of spool.

In addition, it is advantageous if the guard element is designed as a plate. Such a plate should be minimally flexible, or inflexible, in order to prevent problems in the winding operation. For this reason, it advantageously consists of metal. As an alternative, a wire mesh can be used which then has a mesh gap which is small enough to prevent reaching through the same. Such a wire mesh offers advantages for weight.

In one preferred implementation of the winding device according to the invention, a limit stop is arranged on the machine frame, which limits the pivot region of the guard element. As such, there is no need to permanently monitor the current position of the guard element to ensure that the guard element is no longer in the region of the wheel. Rather, it is only necessary to push the guard element against the limit stop. However, the limit stop can also be combined with a sensor by means of which it is possible to monitor whether the guard element has actually reached its end position.

In addition, for the same reasons, it may be advantageous to include such a limit stop on the wheel.

It is particularly advantageous to include a pressurized air cylinder as the pivot drive. This pivot drive can be attached with articulation both to the machine frame and to the guard element. Additional intermediate components can also be included—instead of a direct attachment to the machine frame—such that the drive is only indirectly connected to the machine frame. Rather than the pressurized air cylinder, other pivot drives can also be included—by way of example a cable pull or chain pull, wherein the cable or the chain is wound on a roll driven by a motor, and thereby shortened.

Additional embodiments of the invention proceed from the description of the subject matter and the claims.

BRIEF DESCRIPTION OF THE DRAWINGS

In the individual FIGURES:

The drawing FIGURE shows a lateral view of a winding device.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The drawing FIGURE shows a lateral view of a winding device 1, which is designed as a so-called turret winder. The central element of this winding device is the wheel 2, which is mounted in a manner allowing rotation in the machine frame 4—specifically in the side wall thereof—via bearings 3. The wheel 2 carries multiple—and in the embodiment shown, three—winding points 5, 5', 5" which are mounted in the wheel in a manner allowing rotation. The winding points, which can typically be formed by winding shafts, each carry one or more winding sleeves 6, 6', 6" which typically consist of cardboard.

The winding point 5 has already been configured with at least one new winding sleeve 6, and is in the ready position. From there, it can be moved into the winding position in which the winding point 5" is currently found. This would occur by a rotation of the wheel 2 in the direction of the arrow D. Put more generally, the winding point 5 is in the loading and/or equipping position which functions primarily for the placement of new winding sleeves 6.

There is a functional and also spatial separation from the winding point 5', which is in the unloading position in the embodiment shown. This separation is particularly included in instances where frequent spool changes are performed, thereby frequently avoiding a situation where the same winding point is unloaded and reloaded between two spool changes. These frequent spool changes occur particularly when the intended size of the finished spool is so small that the spool can be conveniently carried by one person. This is the case, by way of example, for stretch films which are commonly used to secure wares stacked on palettes such that they do not fall off. When enclosing these wares, the person unwinds the film from the spool.

The winding of stretch film onto spools of relatively small dimensions (axial length of maximum 80 cm, spool diameter of maximum 40 cm) is therefore one of the preferred areas of application of the winding device according to the invention.

The winding point 5' still carries a finished spool 7 which is ready to be unloaded. For this purpose, a support device 8 is included, wherein the spool 7 is placed thereon and the same can be transported away.

The winding sleeve 6" on the winding point 5" is being wound. The winding point 5" can be driven by a motor for this purpose. To reduce the incorporation of air into the windings, a contact roll 10 is brought into contact with the spool 9 currently being formed, which presses the material web 11—particularly the film—against the spool. In order to make it possible for the contact roll 10 to accordingly follow the changing diameter of the spool, it is mounted on a lever arm 12 in a manner allowing rotation—and advantageously with a drive. This lever arm is attached to the machine frame 4 in a manner allowing pivoting. The material web is fed via the guide roll 13. A piston cylinder unit 14 is included, by means of which it is possible to apply a defined force such that the contact roll 10 bears on the spool with the desired pressure. The winding point 5" and the contact roll 10 rotate in the direction of rotation, which is indicated by the arrows $R_W$ and/or $R_K$, respectively. The winding point 5" and the contact roll 10 form a roll gap 15 which is referred to further below.

At this point, the process of the changing of the spool is not addressed in further detail.

Both the loading of the winding point 5" and the unloading of the winding point [sic] 6 can be performed automatically. However, particularly in the case of stretch film being wound, the situation occurs from time to time that it is necessary to intervene manually—particularly in the unloading process. For example, it may be necessary to remove film which has adhered to a machine frame. Because the peripheral speeds of the rotating components can be considerable, however, there is a health hazard for the machine operator. By way of example, parts of the operator's clothing can quite quickly become caught in the roll gap 15, which can have unpleasant consequences.

To prevent this, without the need to stop the winding process, a guard element 20 is included which can be a metal sheet or a plate, for example. The guard element preferably covers the entire area of the winding points 5, 5', and 5" in the axial dimension thereof. The guard element is preferably sized and arranged such that it breaks the direct joining line between the axes of the winding points 5 and 5". In this way, an effective protection against reaching into the winding gap 15 is ensured.

If the loading and unloading of the respective winding point is complete, the guard is no longer needed. Specifically, it would prevent the rotation of the wheel 2 in the position shown. For this reason, the guard element 20 is attached with articulation to the triangular support 21, and is able to pivot in the direction indicated by the double arrow S.

For the pivot movement itself, a piston cylinder unit 22 is included, which can be linked on one side thereof to the machine frame 4, and on the other side thereof to the guard element 20. Instead of the linkage to the machine frame 4, a linkage to the support 23 is illustrated, wherein the same can be attached to the traverse beam 24. The illustrated and described arrangement of the piston cylinder unit is advantageous for the following reason: in the event that the cylinder of the piston cylinder unit is switched to unpressurized operation as the result of a malfunction, the guard element automatically falls into the position which provided a guard. As far as the rotation of the wheel is concerned, this would mean that the winding point 5 would push the guard element out of the way during the rotation.

Finally, a limit stop 25 is included, wherein the guard element 20 is pressed against the same by the piston cylinder unit 22 when the guard element is not needed. This limit stop 25 can be replaced by a sensor, or combined with such a sensor, as described above.

With regard to the present invention, various different features, which are clearly advantageous, have been described in this text at various points. Even without specifically having been addressed, all of these features can be freely combined with each other without departing from the scope of the invention.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of reference numbers | |
|---|---|
| 1 | winding device |
| 2 | wheel |
| 3 | bearing |
| 4 | machine frame |
| 5, 5', 5" | winding point |
| 6, 6', 6" | winding sleeve |

-continued

| List of reference numbers | |
|---|---|
| 7 | spool |
| 8 | support device |
| 9 | spool |
| 10 | contact roll |
| 11 | material web |
| 12 | lever arm |
| 13 | guide roll |
| 14 | piston cylinder unit |
| 15 | roll gap |
| 16 | |
| 17 | |
| 18 | |
| 19 | |
| 20 | guard element |
| 21 | triangular support |
| 22 | piston cylinder unit |
| 23 | support |
| 24 | traverse beam |
| 25 | limit stop |
| $R_W$ | direction of rotation |
| $R_K$ | direction of rotation |
| S | pivot direction |

What is claimed is:

1. A winding device for successively winding a material web onto spools, comprising:

a machine frame;

a wheel which is rotatably mounted on the machine frame;

at least a first winding point and a second winding point for carrying the spools, which are mounted in the wheel in a manner allowing rotation thereof, with the first winding point being positionable in a winding position, and the second winding point being positionable in at least one of a loading position and an unloading position; and a guard element that is pivotably positionable in a region between the spools respectively associated with the first winding point and the second winding point, with a pivot axis of the guard element being parallel to a winding axis of the first winding point and the second winding point.

2. The winding device according to claim 1, wherein the guard element is pivotably mounted on the machine frame.

3. The winding device according to claim 1, wherein the guard element is configured as a plate.

4. The winding device according to claim 1, further comprising a limit stop arranged on the machine frame to limit the pivotability of the guard element to a prescribed range.

5. The winding device according to claim 1, wherein the guard element is movable with a piston cylinder unit.

6. The winding device according to claim 1, wherein the material web is a plastic film web.

* * * * *